United States Patent [19]

Schulze et al.

[11] Patent Number: 4,803,862

[45] Date of Patent: Feb. 14, 1989

[54] POSITIONING OF EDGE ROLLS

[75] Inventors: Dieter Schulze, Ratingen; Karl-Heinz Margraf, Langenfeld, both of Fed. Rep. of Germany

[73] Assignee: Mannesmann AG, Duesseldorf, Fed. Rep. of Germany

[21] Appl. No.: 76,068

[22] Filed: Jul. 21, 1987

[30] Foreign Application Priority Data

Jul. 23, 1986 [DE] Fed. Rep. of Germany ..... 3624958

[51] Int. Cl.[4] ..... B21B 31/20

[52] U.S. Cl. ..... 72/199; 72/245; 72/248

[58] Field of Search ..... 72/199, 248, 247, 245, 72/243, 249

[56] References Cited

U.S. PATENT DOCUMENTS 4,395,898 8/1983 Kegel ..... 72/248 X
4,497,215 2/1985 Gronbech et al. ..... 72/248 X

FOREIGN PATENT DOCUMENTS 0144312 11/1980 Japan ..... 72/245
0014014 2/1981 Japan ..... 72/247
0031405 2/1982 Japan ..... 72/243
0030407 2/1984 Japan ..... 72/243

*Primary Examiner*—Robert L. Spruill
*Assistant Examiner*—Steven B. Katz
*Attorney, Agent, or Firm*—Ralf H. Siegemund

[57] ABSTRACT

A positioning device for rollers in an edging stand includes two hydraulic cylinder piston adjusting drives being laterally offset from each other and from a vertical plane; further included are two spindle drives each with a spindle and a nut, the spindles being arranged one above the other in that plane, the stand further includes a cross head and a coupler plate which holds the nuts and is articulated to the pistons of the cylinder piston adjusting drives while the cylinders are articulated on the cross head.

4 Claims, 3 Drawing Sheets

POSITIONING OF EDGE ROLLS

BACKGROUND OF THE INVENTION

The present invention relates to the control of positioning of and within vertical upset edging devices ultimately for purposes of controlling the width of flat rolled stock. The device is to include electrical spindles and spindle drives combined with hydraulic, servo-valve controlled piston cylinder arrangement to work against the load of the rolling process.

Generally speaking vertical edging devices are known for purposes of correcting the width of rolled stock. Herein controls are used which, on one hand, offset width variations of the rolled stock in the direction of rolling including certain deviations from a desired width as well as from a mean or actual actual width values. Known controllers of vertical upset edging or stands include combined electric spindle drive and hydraulic adjusting mechanism. The spindle drives establish a zero and starting position in the idle situation and in terms of defining the rolling gap. The hydraulic piston cylinder drives will take up those adjustments which of course have to be carried out against the load of the rolling process. This position control is, as far as construction details are concerned, coupled directly to the nut of the threaded spindle system, or even establishes by itself that nut which then is moved through the cylinder and in a sliding fashion within the rolling stand. This particular approach serves the purpose to protect the hydraulic cylinder against direct heat radiation of the rolling process and to avoid negative interference of the descaling process.

The known approach is disadvantaged by the fact that the enhanced protection against outer interference causes unfavorable conditions as far as accessibility of various pieces of equipment are concerned. This has directly a bearing on removal and replacement for purposes of maintenance or the like.

DESCRIPTION OF THE INVENTION

It is an object of the present invention to provide a new and improved positioning device of the type generally referred to above which is to be simplified from a point of view of construction so that, on one hand, the protection of important parts against external interference is not compromised while various parts which have to be accessed are in fact more easily accessed for purposes of maintenance or the like.

It is a specific object of the present invention to provide a new and improved positioning control for vertical edging mill stands and used for purposes of width control of flat rolled stock under utilization of an electric spindle drive combined, and coacting, with hydraulic servo-valve controlled, piston cylinder drive means that operates and acts against the rolling load.

In accordance with the preferred embodiment of the present invention it is suggested to position the cylinder or cylinders of the aforementioned piston cylinder drive means such that they are laterally displaced from the spindle or spindles that are connected with the respective operating nut or nuts of the threaded spindle drive means by means of a coupler plate being arranged on the front side of the stand head or on the rear thereof. The coupler plate could be made by two crosswise linked parts details of which will be described more fully below.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 illustrates schematically a major portion of a vertical upsetting stand S in cross section whereby the cross section plane runs through a hydraulic drive that includes a cylinder 4 and a piston 4a, for purposes of positioning the rolls such as W and holding them under rolling pressure. The roll W and others rotate on vertical axes. Also included is an electrically operated adjusting spindles 3. A stand cross head is designated in FIG. 1 with reference numeral 5, and provides for a mount of threaded slide nuts 2 which respectively ride on the spindle 3 (see FIG. 2). The nuts 2 do not rotate but as the respective spindle 3 rotates it moves also axially because it (the spindle) is held by the nuts. The nuts are held in a neutral portion of cross head 4.

As shown in FIG. 2 the hydraulic adjusting cylinders 4 are supported on both sides with regard to a plane that runs through the center of the two threaded spindles 3. Support of the cylinders 4 is needed on the cross head 5 through the cylinders 4 are laterally offset and outside of the central portion of the cross head that holds nuts 2. The specific support for each cylinder includes a pressure element 6 in each instance, which has a curvature to. correspond to the bottom of the respective cylinder. Specifically, concave bulging or barrel shaped and spherically shaped heads of elements 6 matchingly engage concave recesses in cylinders 4. This configuration permits, within a limited range, a certain oblique position of the respective cylinder 4.

Figure 1:
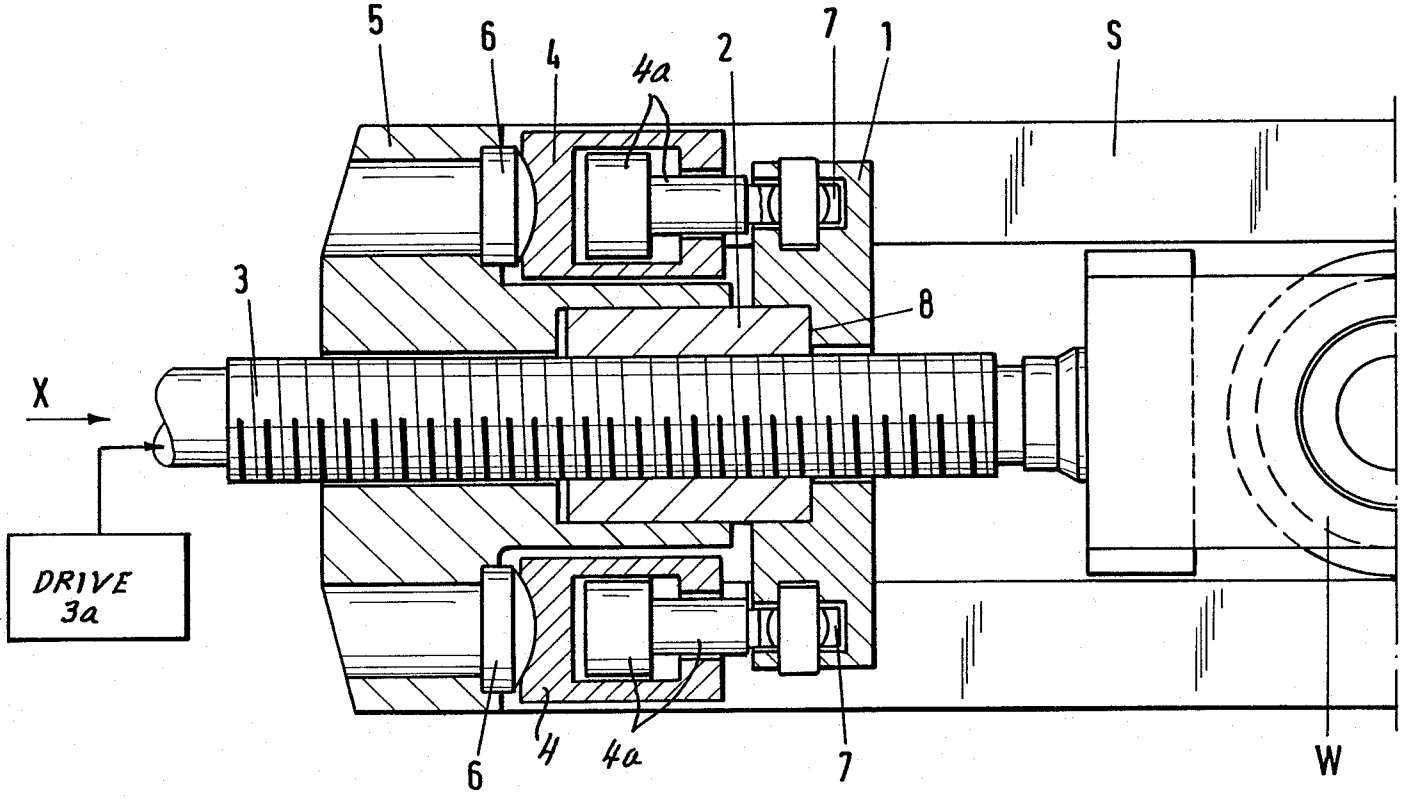
FIG. 1 is a cross section through a roll stand for edging including a positioning control device and coupler plate positioned on the inside and in accordance with the preferred embodiment of the present invention.

As can be seen specifically, the pistons 4*a* of the hydraulic drives have their ends 7 articulated to a coupler plate 1. These ends 7, of course, project from the cylinders 4 in the direction towards the rolls W. The plate 1, on the other hand, serves as actual support for the nut 2 at the specific location 8. Thus, the spindles 3 hold the rolls W; the nuts 2 on the spindles hold plate 1 which in turn is acted upon by piston rods 4*a*.

Figure 2:
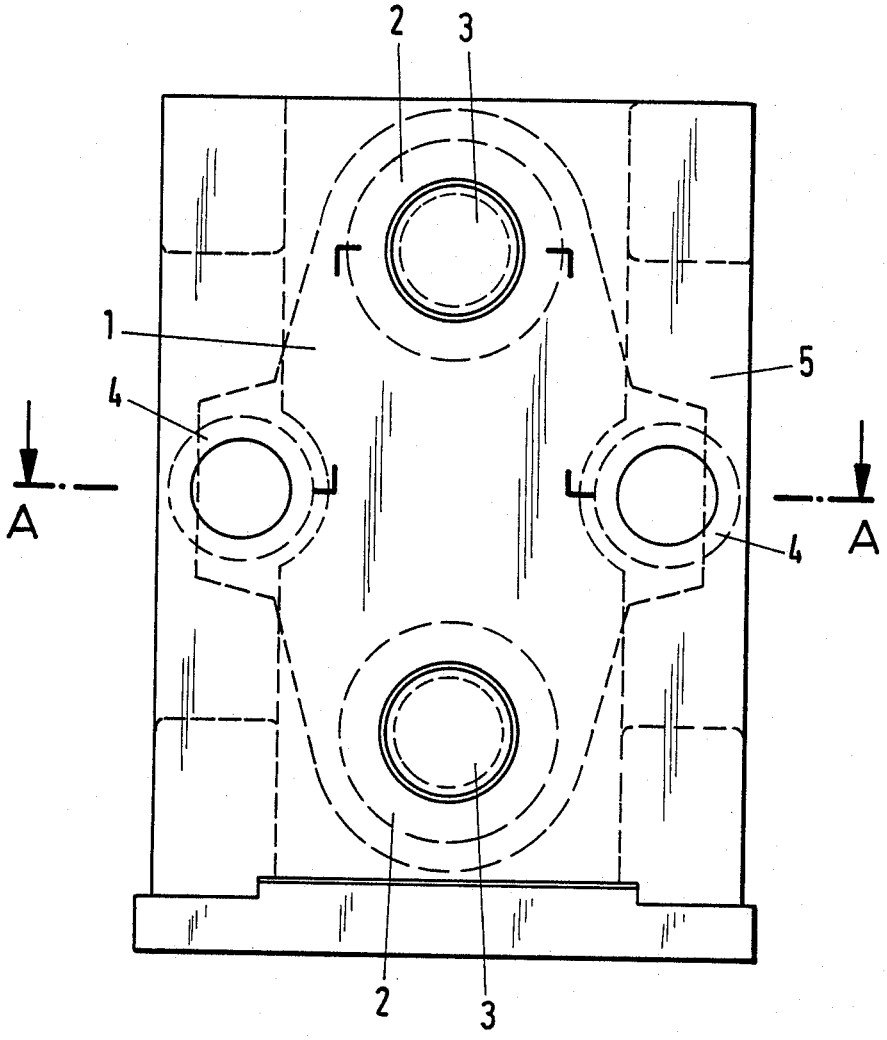
FIG. 2 is a view as indicated by arrow X in FIG. 1, presenting also a plane AA in which the section of FIG. 1 is taken.

The coupler plate 1 is also shown in FIG. 2 and is shaped corresponding to the requirements and conditions of space between the stand and the cross heads 5 of the stand, whereby the hydraulic cylinders 4 will always be freely accessible owing to their laterally displaced positions! This is a principal feature for facilitating removal and insertion.

The invention offers an approach in which the cylinders cannot only be disconnected from the threaded spindle drive but owing to the laterally displaced position they are easily accessible even when mounted and therefore can be mounted or disconnected without problems. The connection between the electrical spindle drive and the nuts 2 thereof on one hand and the cylinders 4 on the other hand is, as per the principal feature, carried out by means of that coupler plate which does not only provide for this coupling function but owing to its particular physical dimension and position it protects the cylinder against any interference from the rolling area such as large radiation or the like.

Figure 3:
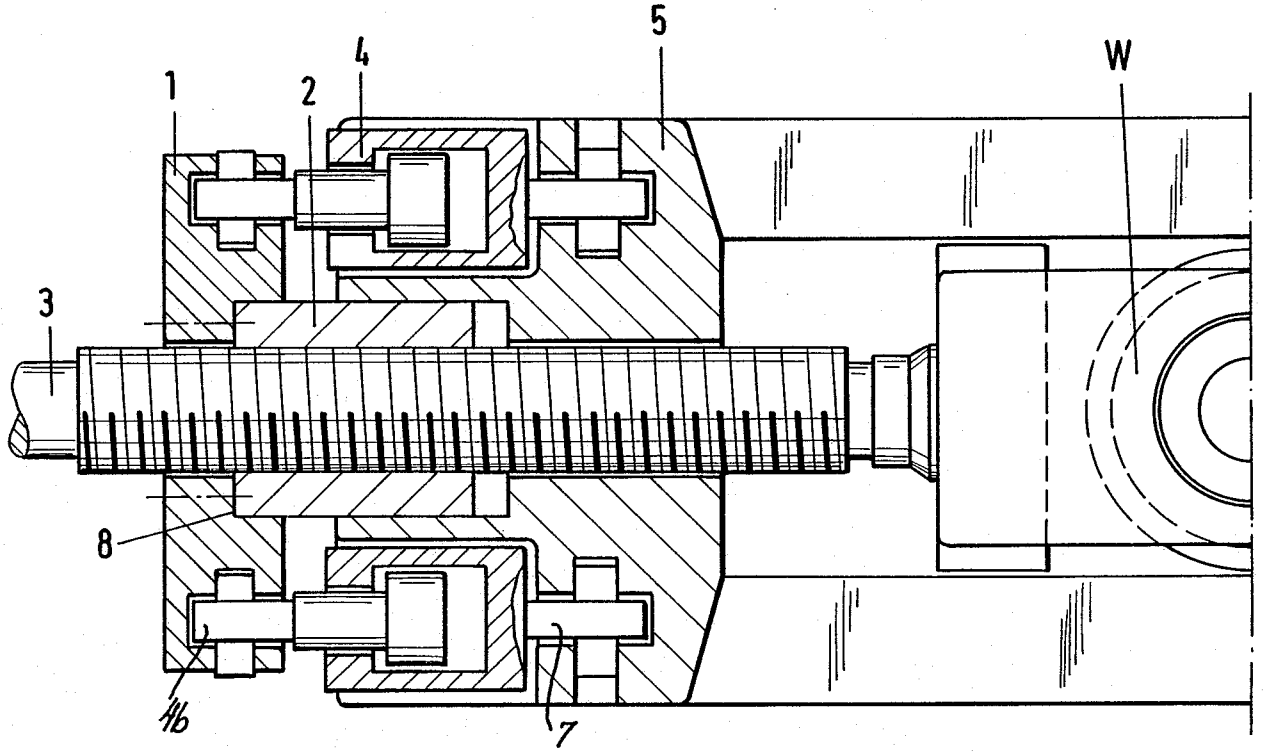
FIG. 3 is a modification of the invention by having specifically the coupled plate in the rear rather than in the front as shown in FIG. 1 and 2.

FIG. 3 illustrates a similar construction as shown in FIG. 1 with a difference however in that in this case the particular coupler plate 1 is situated on the cross heat 5 at a side facing away from the rolls W. However, also here there is articulation (4*b*) of the hydraulic cylinders 4 to the cross heads 5. The connection of the plate 1 to the pistons 4*a* is one of the same articulated configuration outlined above and again a limited skew of the plate 1 can be compensated for.

The invention is not limited to the embodiments described above but all changes and modifications thereof, not constituting departures from the spirit and scope of the invention, are intended to be included.

What is claimed is:

1. A positioning device for rolls in an edging stand, there being hydraulic cylinder piston adjusting means and spindle adjusting means including at least one nut, the stand further including a cross head, and one or more adjusting spindles, the improvement comprising:

there being two cylinders, the two cylinders of the cylinder piston adjusting means being positioned outside of said cross head, and laterally offset to the spindle or spindles, laterally being in relation to a spindle axis, the cross head having central means for holding the, at least one nut, the cylinders being laterally spaced from said central means; and a coupler plate holding and positioning said nut and being coupled to said cylinder piston adjusting means.

2. A positioning device for rollers in an edging stand, there being hydraulic cylinder piston adjusting means and spindle adjusting means including at least one nut, the stand further including a cross head, the improvement comprising:

two spindles traversing centrally the cross head, two cylinder-piston adjusting means being laterally spaced in relation to each other and being laterally spaced from a vertical plane; as well as outside of the cross head, and being laterally displaced from portions of the cross head being traversed by the spindles;

there being two spindle drives each with one of the spindles and a nut, the spindles being arranged one above the other in said plane;

a coupler plate holding said nuts and being articulated to said cylinder piston adjusting means; and means for articulating the two cylinder piston adjusting means also on the cross head.

3. A device as in claim 2, the coupler plate facing away from rolls in the stand, the pistons being articulated in the plate, the cylinders in the cross head.

4. A device as in claim 2, the coupler plate facing rolls of the stand, the pistons being articulated on the plate; further including press elements having convex ends being matchingly received by and held against concave bottoms of the cylinders.

* * * * *